United States Patent [19]

Maier

[11] 4,040,594

[45] Aug. 9, 1977

[54] ARRANGEMENT FOR CONNECTING AND ALIGNING ADJACENT CASTING FORMS FOR THE CONSTRUCTION OF MULTI-STORY BUILDINGS

[76] Inventor: Josef Maier, Kreuzbuhlstr. 5, 7611 Steinach, Germany

[21] Appl. No.: 670,175

[22] Filed: Mar. 24, 1976

[30] Foreign Application Priority Data

Mar. 29, 1975 Germany ..... 2514043

[51] Int. Cl.[2] ..... E04G 11/02

[52] U.S. Cl. ..... 249/27; 249/28; 249/40; 249/177

[58] Field of Search ..... 264/33, 34; 249/26–28, 34, 39, 180–182, 184–185, 188, 40, 177

[56] References Cited

U.S. PATENT DOCUMENTS

| | | | |
|---|---|---|---|
| 3,689,019 | 9/1972 | Ferenc | 264/33 |
| 3,810,601 | 5/1974 | Miram | 249/188 |
| 3,815,861 | 6/1974 | Maier | 249/27 |
| 3,961,457 | 6/1976 | Zalewski | 249/26 |

*Primary Examiner*—Francis S. Husar
*Assistant Examiner*—John McQuade
*Attorney, Agent, or Firm*—Michael J. Striker

[57] ABSTRACT

A method and an arrangement for connecting and aligning adjacent casting forms for the construction of multi-story buildings in which upper ends of vertical panels of adjacent forms are releasably connected by an intermediate body, spaced from each other according to the thickness of a vertical concrete wall to be cast therebetween. The intermediate body projects with an end portion upwardly beyond horizontal panels of the forms for a distance greater than a ceiling to be cast on these horizontal panels. A pair of parallel structural channels are releasably connected spaced from each other the same distance as the vertical panels to the projecting portion of the intermediate body so that after casting the vertical walls and the ceiling for one story and hardening of the concrete, the intermediate body and the casting forms may be removed and the latter re-erected for the next story properly aligned on the channels which have been left in place on the cast ceiling.

13 Claims, 4 Drawing Figures

ARRANGEMENT FOR CONNECTING AND ALIGNING ADJACENT CASTING FORMS FOR THE CONSTRUCTION OF MULTI-STORY BUILDINGS

BACKGROUND OF THE INVENTION

The present invention relates to apparatus for connecting and aligning adjacent casting forms spaced from each other according to the thickness of a vertical wall to be cast. After casting the concrete of one story of the building, the forms are removed and re-erected on profiled rails or similar elements for the casting of the next story of the building, whereby the casting forms are, preferably, re-erected for casting the next story that the vertical walls of the individual stories of the building are in vertical alignment with each other.

During casting of buildings from concrete by means of casting forms, the problem arises to properly locate the casting forms, after casting one story, for the casting of the next story. It has already been suggested to provide on the casting forms in the region of the horizontal panels thereof a socket or bushing serving as locating means for the bottom support of a casting form during the re-erection for casting the next story.

The so far known casting forms and the methods of erecting the same have also the disadvantage that tie rods are usually necessary for connecting adjacent casting forms which increase the time necessary for erection and removal of the casting forms.

SUMMARY OF THE INVENTION

It is an object of the present invention to provide apparatus as mentioned above by means of which the proper alignment of adjacent casting forms can be simplified and the necessity of providing a socket or the like embedded in the concrete of the ceiling may be avoided.

With these and other objects in view, which will become apparent as the description proceeds, the apparatus according to the present invention for connecting and aligning adjacent casting forms for the construction of multi-story buildings mainly comprises the steps of connecting vertical panels of adjacent forms in the region of the upper ends thereof by means of at least one intermediate body projecting with a portion thereof upwardly beyond horizontal panels of the forms for a distance greater than the thickness of a ceiling to be cast on the horizontal panels, and connecting profiled rails, or the like, to the projecting portion of the intermediate body spaced from each other corresponding to the thickness of a vertical wall for the next story of the building and spaced from the horizontal panels according to the thickness of the ceiling to be cast on the latter.

Thereby the profiled rails for the next story assume already their exact position during erection of the casting forms for the casting of one story so that the casting forms for the next story may be properly aligned on the profiled rails. In addition the thickness of the ceiling to be cast is already exactly determined.

After the concrete of the cast vertical walls and the ceiling of one story has at least partially hardened and after the profiled rails are disconnected from the intermediate body, the latter is upwardly withdrawn so that the rails rest now on the cast ceiling and are now connected by horizontally extending distant holding tie rods, or similar elements, with each other. The thus properly located profiled rails on the cast ceiling may now serve to support the vertical panels of the casting forms in proper alignment during re-erection of the casting forms for the casting of the next story, whereby considerably time is saved for the subsequent re-erection of the casting forms. This method has also the advantage that the pressure of the cast concrete will be transmitted from the casting forms over the profiled rails onto the tie rod.

The intermediate body is connected to the vertical panels by means of bolts passing through aligned openings in the panels and the intermediate body, and after removal of the bolts and upward withdrawal of the intermediate body the openings in the panels are closed, and the open space formed by removing the intermediate body is filled with concrete.

The casting forms are removed after casting one story of the buildings and then re-erected for the casting of the next story, with the vertical panels of adjacent forms aligned on the profiled rails, so that the vertical wall for the next story will be cast in proper vertical alignment with that of the prior cast story.

The various steps according to the method disclosed herein have the advantage that by connecting the profiled rails for the next story, immediately after casting the concrete for the lower story, considerable time is gained, and further that the tie rods in the region of the horizontal panels of the casting forms are avoided, whereby removal of the casting forms after casting one story is simplified. This will permit to gain valuable time for installing reinforcing rods for the concrete and for carrying out electrical installations. By proper timing it is therefore possible to let the concrete harden during the night, to re-erect the casting forms for the casting of the next story during the following morning, and to use the remainder of the following day for casting the concrete for the next story.

The present invention relates also to an arrangement for casting a multi-story building from concrete, in which at least one intermediate body is arranged between vertical panels of adjacent casting forms, projecting with an upper portion thereof beyond the horizontal panels of the forms for a distance greater than the thickness of the ceiling to be cast on the horizontal panels, in which a lower portion of the intermediate body is releasably connected with the vertical panels of adjacent forms and in which carrying means are provided on the projecting portion of the intermediate body for carrying a pair of profiled rails spaced from each other a distance corresponding to the thickness of a wall to be cast between the vertical panels of the forms and extending parallel to each other in the direction of the vertical panels and spaced from the horizontal panels of the adjacent casting forms a distance corresponding to the thickness of a ceiling to be cast on the horizontal panels. The intermediate body is preferably hollow and provided with an opening so that an operator may reach into the interior of the hollow body, so that the connecting means connecting the intermediate body to the vertical panels of the casting forms may be easily disconnected.

The intermediate body permits therefore, on the one hand, the connecting of vertical panels of adjacent forms in proper distance from each other, and, on the other hand, the exact arrangement and alignment of the profiled rails for the next story, which in turn will permit a proper arrangement and vertical aligment of the casting forms for the casting of the next story.

The novel features which are considered as characteristic for the invention are set forth in particular in the appended claims. The invention itself, together with additional objects and advantages thereof, will be best understood from the following description of specific embodiments when read in connection with the accompanying drawings.

Figure 1:
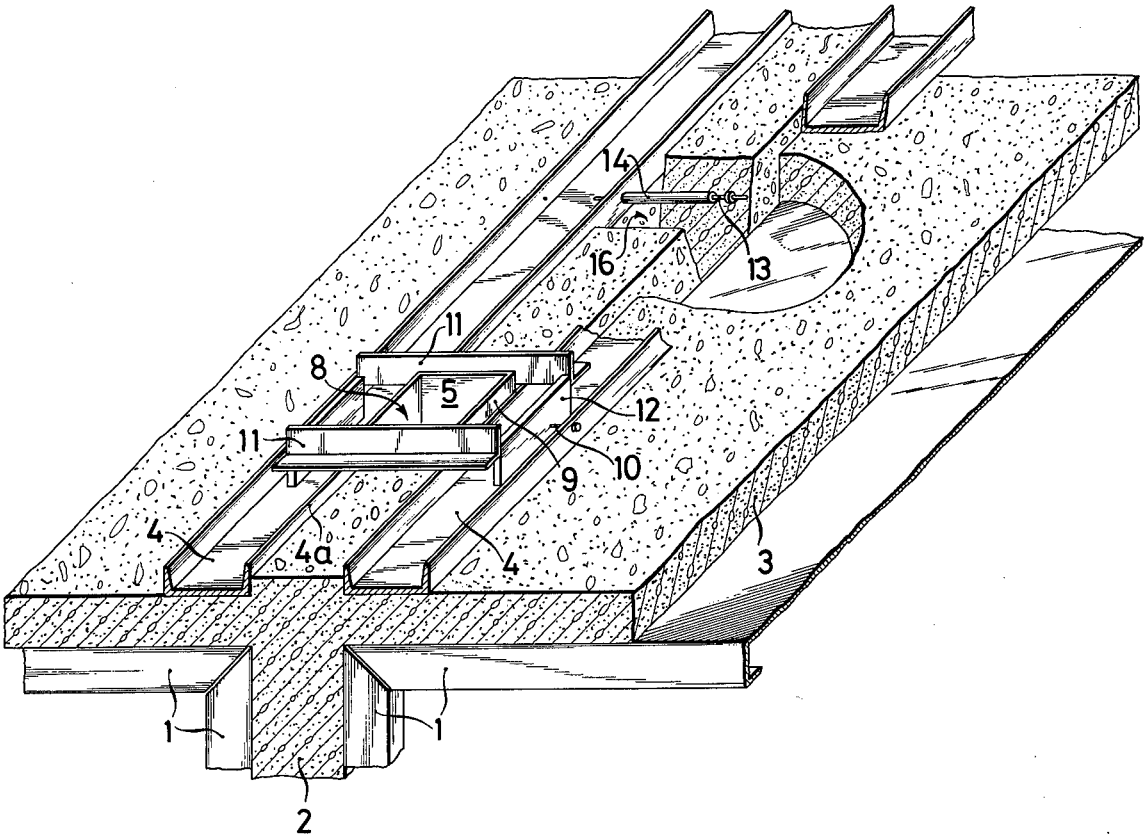
FIG. 1 is a perspective partially sectioned and partially broken away view of the upper region of a vertical wall and a ceiling of concrete and a portion of the casting forms with an intermediate body and profiled rails held thereby, and with a second intermediate body already removed from the cast vertical wall.
Figure 2:
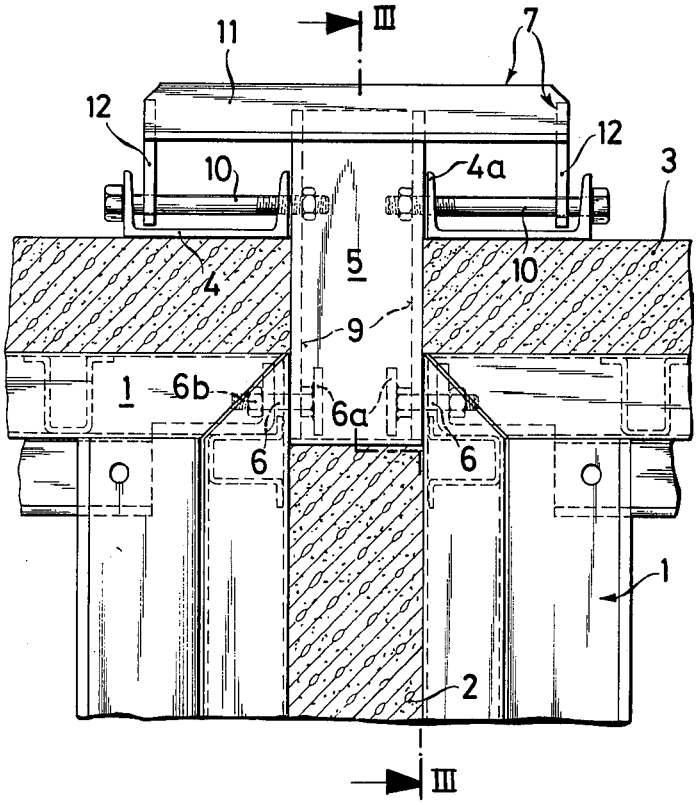
FIG. 2 is a front view of an intermediate body and upper portions of adjacent casting forms connected thereto as well as profiled rails connected to the intermediate body.
Figure 3:
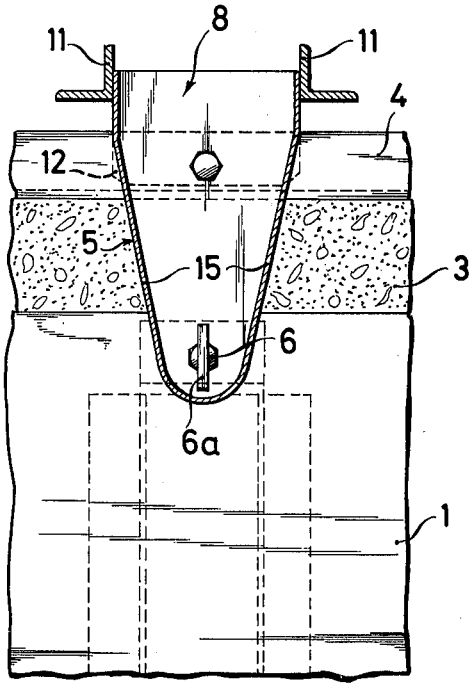
FIG. 3 is a cross-section taken along the line III—III of FIG. 2.
Figure 4:
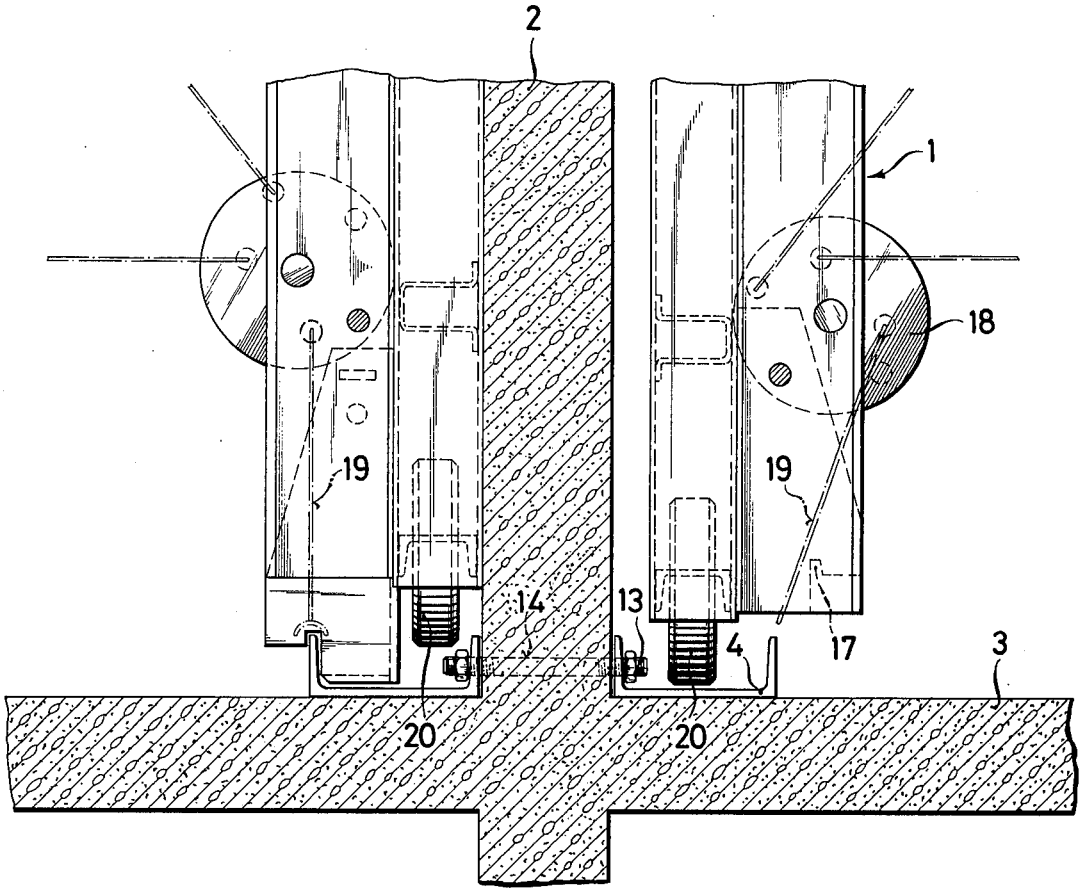
FIG. 4 is a front view of the lower region of two adjacent casting forms and profiled rails cooperating therewith.

DESCRIPTION OF THE PREFERRED EMBODIMENTS:

FIGS. 1–3 illustrate the upper region and FIG. 4 the lower region of two casting forms 1 arranged with the vertical panels of the adjacent forms spaced from each other a distance corresponding to the thickness of a vertical wall 2 to be cast therebetween. The casting forms serve for simultaneous casting of a vertical wall 2 and the ceiling 3 of one story of a multi-story building. After the concrete is cast, the casting forms 1 are removed and then re-erected on the cast ceiling 3 for the casting of the vertical wall and the ceiling of the next story. The casting forms 1 are only schematically illustrated in the aforementioned Figures and it is to be understood that each of the casting forms comprises also a second vertical panel connected at the other end to the horizontal panel means, and that the horizontal panel means are formed of two parts hingedly connected at the outer ends to the vertical panels and at the inner ends to each other, so that the casting forms may be collapsed for removal of the same after vertical walls and the ceiling of one story of the building have been cast thereon. The specific construction of the casting form does not form part of the present invention and such construction is disclosed in the U.S. Pat. No. 3,815,861 of the same inventor, to which reference may be had for the details of the construction of the casting form 1. The vertical panels of the casting form are mounted on profiled rails 4, which are preferably in the form of structural channels, and the casting forms 1 can be fixed properly aligned by means of the profiled rails 4, as shown in FIG. 4, so that the vertical walls of the stories of the building will be in vertical alignment with each other.

As shown in FIGS. 1–3, an intermediate body 5 is used to connect and properly align the vertical panels of adjacent casting forms 1 at a distance from each other corresponding to the thickness of a vertical wall 2 to be cast therebetween. The intermediate body 5 is connected at its lower portion by means of fastening elements 6 with adjacent casting forms and the intermediate body carries in its upper region means for carrying profiled rails or structural channels 4. The intermediate body is hollow and provided with an opening so that an operator may reach thereinto, whereby the fastening elements 6 are easily accessible and must not be constructed as a tie rod extending through the intermediate body. In the illustrated embodiment the intermediate body 5 is provided with an upper opening 8 which may be closed by means of a cover, not shown in the drawing, to avoid inadvertent casting of concrete into the intermediate body.

The connecting elements for connecting the intermediate body 5 in its lower region with the casting forms 1 are preferably in the form of turnable bolts 6 provided with hand grips *6a* in the interior of the hollow body. The connecting bolts 6 may be connected by means of a bayonet joint to the vertical panels of the adjacent forms 1, or, as shown in the drawing, the bolts 6 may be provided on the outer ends with threads and connected to the vertical panels by nuts *6b*. This arrangement has the advantage that the casting forms 1 may be connected at their uppermost region a short distance beneath their vertical panels by means of the intermediate body 5. This connection can be carried out in a very convenient manner by a single operator. The construction of the connecting bolts makes the connection and disconnection of the intermediate body 5 with the adjacent casting forms considerably simpler than a connection with a tie rod extending in one piece through the intermediate body.

As evident from FIG. 3, the walls 15 of the intermediate body are inclined with respect to each other and form between themselves a space which gradually increases toward the upper end of the intermediate body, whereas the sidewalls 9 of the intermediate body extend, as shown in FIG. 2, parallel to each other, with the outer surfaces thereof spaced from each other corresponding to the thickness of the concrete wall 2 to be cast between the vertical panels of the adjacent forms 1. The bottom of the intermediate body 5 is rounded and the shape thereof facilitates upward removal of the intermediate body after the concrete has been cast.

The parallel sidewalls 9 of the intermediate body are provided in the upper region thereof with transversely aligned openings for the passage of fastening bolts or fastening screws 10 therethrough for the connection of structural channels 4 to the sidewalls 9. As best shown in FIG. 2, at least one bracket 11 is connected to the upper portion of the intermediate body 5. The bracket 11 is provided at its outer ends with means for supporting the structural channels 4 also on the flanges thereof distant from the intermediate body 5. According to the embodiment shown in FIGS. 1 and 3, two such parallel brackets 11 are provided at the upper region of the intermediate body. The outer ends of the brackets 11 are connected by downwardly extending flaps 12, provided with openings therethrough for bolts 10 which extend also through corresponding openings in the sidewalls 9 of the intermediate body 5.

According to FIG. 2, the two structural channels 4 may be arranged with one of the flanges thereof abutting directly onto the sidewalls 9 of the intermediate body 5. The channels 4 are respectively connected by bolts 10 extending through aligned openings in the flanges and the flaps 12 of the brackets 11 to the intermediate body 5. The outer flanges of the structural channels 4 are preferably located outside the flaps 12 so that the outer flanges of the structural channels 4 may serve as guide for a strip used for smoothing the upper surface of the cast ceiling 3.

As already mentioned above, the profiled rails are in the form of U-shaped structural channels 4, which at least in the flanges thereof, which in the assembled position abut against the sidewalls 9 of the intermediate body 5, are provided with openings aligned in transverse direction with each other and having a diameter corresponding substantially to the diameter of the openings in the sidewalls 9 of the intermediate body and those in the flaps 12, as well as to the outer diameter of a tie rod 13 (FIG. 1). Thereby these openings in the structural channels have a double function in that, on the one hand, they serve for the connection of the structural channels 4 to the intermediate body 5, and on the other hand, as shown in FIGS. 1 and 4, for the reception of a tie rod 13. As shown in FIG. 1, the tie rod 13 is surrounded by a tube 14 which remains in the concrete, and which serves as a distancing member between the inner flanges of the two structural channels 4.

The inclined transverse walls 15 of the intermediate body are preferably bent from sheet metal in one piece and the sidewalls 9 are welded thereto. This will result in a simple construction of the intermediate body 5.

Approximately in the region of the upper edges of the flanges 4*a* of the structural channels 4, the inclined transverse walls 15 of the intermediate body have upwardly extending portions which extend, in assembled position, in vertical direction, and the brackets 11 are connected to the vertical portions of the transverse walls 5, preferably by welding.

The described arrangement is used in the following manner:

Two adjacent casting forms 1 are connected in the region of their upper ends by an intermediate body 5 projecting with an upper portion beyond the thickness of a ceiling to be cast on the horizontal panels of the casting forms, and the structural channels 4, for the next story of the building to be erected, are connected to opposite sidewalls of the intermediate body 5 at a distance from each other corresponding to the thickness of vertical wall 2 to be subsequently cast and at a distance from the horizontal panels of the two casting forms corresponding to the thickness of the ceiling 3 to be cast onto the horizontal panels of the casting forms 1. In this way the two casting forms 1 are properly connected in the region of their upper ends, while simultaneously the structural channels 4 for the next story of the building are already properly aligned, so that they may serve subsequently for the alignment of the casting forms 1 during the construction of the next story of the building. In addition thereto the thickness of the ceiling 3 is already established.

After casting the concrete for the vertical walls 2 and the ceiling 3 of one story and after at least partially hardening of the concrete, the intermediate body 5 is pulled upwardly out of the concrete, which is facilitated by the specific form of the intermediate body. Before the intermediate body 5 is upwardly withdrawn, the structural channels 4 are disconnected therefrom and these channels, now resting on the concrete of the cast ceiling, are connected to each other by tie rods 13, each surrounded by a tube 14 abutting with outer end faces thereof against the inner flanges of the two channels, maintaining thereby the channels at the proper distance from each other. By thus connecting the two structural channels 4 to each other, the lower bracing location for the subsequently to be erected casting forms can therefore be provided immediately after casting the concrete for the ceiling 3 of one story. An additional advantage is thereby derived, as shown in FIG. 4, that during shaking and smoothing of the ceiling 3, the still liquid concrete is driven upwardly between the inner flanges of the two structural channels, whereby the latter are further secured at a proper distance from each other.

After removal of the intermediate body 5, the openings in the vertical panels of the casting forms, through which the connecting bolts 6 extended, are now closed and subsequently thereto the opening 16 resulting in the vertical wall by removal of the intermediate body 5 (indicated in FIG. 1 in the rear portion of the wall 2) is filled with concrete. This filling of the opening 16 with concrete is of course carried out after the tie rods 13 are connected to the inner flanges of the structural channels 4 and the mounting of the tie rods is facilitated by the opening 16.

After the vertical wall or walls 2 and the ceiling 3 of one story are cast, the casting forms are collapsed and removed from the one story and re-erected subsequently thereto for the casting of the next story, whereby the structural channels 4, resting on the ceiling 3 of the first erected story, serve to properly align the casting forms 1 for the casting of the concrete for the next story. As shown in FIG. 4, each of the vertical panels of the two adjacent casting forms 1 is provided at the lower edge with a cutout 17, which, as shown at the left side of FIG. 4, is engaged by the outer flange of the structural channel 4, when the form 1 is in its working position.

Turnable elements 18, schematically shown in FIG. 4, are provided with a foot support 19 adapted to abut against the outer flange of the respective structural channel 4 or against the upper surface of the cast ceiling for lifting an outer part of the vertical panel in such a manner that a wheel 20 connected to an inner part thereof may be lowered onto the structural channel 4, so that the casting form may travel out of the cast story in a manner known per se and described in detail in the above-mentioned U.S. Pat. No. 3,815,861 to which reference may be had with regard to the construction of the vertical panels and the turnable elements 18 connected thereto.

The described method and arrangement have the advantage that no openings have to be provided below the ceiling, that the removal of the casting forms can be carried out faster than with methods and arrangements known in the art, since in the upper region of the walls 2 no tie rods must be removed. In addition, the casting forms may, after removal thereof from a first cast story, quickly be re-erected on the already properly aligned structural channels for the next story, so that casting of the next story may be carried out soon after casting the first. In addition, during casting of one story it is possible to carry out some of the work for casting the next story, so that the various steps of casting a multi-story building can be carried out in quick sequence.

It will be understood that each of the elements described above, or two or more together, may also find a useful application in other types of methods and arrangements for casting a multi-story building from concrete, differing from the types described above.

While the invention has been illustrated and described as embodied in an arrangement for casting a multi-story building from concrete, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for casting concrete for the erection of a multi-story building having a ceiling and vertical walls in alignment with each other, comprising casting forms each having vertical panel means and horizontal panel means connected to upper ends of said vertical panel means; at least one intermediate body arranged between adjacent vertical panel means of adjacent casting forms to properly space said adjacent vertical panel means and projecting with an upper portion thereof beyond said horizontal panel means of said adjacent casting forms for a distance greater than the thickness of the ceiling to be cast on said horizontal panel means; connecting means releasably connecting a lower portion of said intermediate body with said adjacent vertical panel means of said adjacent forms; a pair of profiled rails; and carrying means on said projecting portion of said intermediate body carrying said rails spaced from each other a distance corresponding to the thickness of a wall to be cast between said vertical panel means and extending parallel to each other in horizontal direction parallel to said vertical panel means and upwardly spaced from the horizontal panel means of said adjacent casting forms a distance corresponding to the thickness of a ceiling to be cast on said horizontal panel means.

2. An arrangement as defined in claim 1, wherein said intermediate body is hollow and provided with an opening so that an operator may reach into the interior of said hollow body.

3. An arrangement as defined in claim 2, wherein said connecting means for releasably connecting said intermediate body with said vertical panel means comprise turnable bolts provided with hand grips in the interior of said intermediate body.

4. An arrangement as defined in claim 2, wherein said opening of said hollow intermediate body is provided at the upper end thereof and adapted to be closed by a cover.

5. An arrangement for casting concrete for the erection of a multi-story building having a ceiling and vertical walls extending to opposite sides of said ceiling and being aligned with each other, comprising casting forms each having vertical panel means and horizontal panel means connected to upper ends of said vertical panel means; at least one intermediate body arranged between adjacent vertical panel means of adjacent casting forms and projecting with an upper portion thereof beyond said horizontal panel means of said adjacent casting forms for a distance greater than the thickness of a ceiling to be cast on said horizontal panel means, said intermediate body having a pair of parallel side walls respectively abutting against the vertical panel means of said adjacent casting forms, said parallel side walls having outer faces spaced from each other a distance corresponding to the thickness of a vertical building wall to be cast between said vertical panel means, and a pair of transverse walls integrally connecting said parallel side walls, said transverse walls being inclined with respect to each other to define between themselves a space increasing in upward direction; connecting means for releasably connecting a lower portion of said intermediate body with said adjacent vertical panel means of said adjacent forms; a pair of profiled rails; and carrying means on said projecting portion of said intermediate body carrying said rails spaced from each other a distance corresponding to the thickness of a wall to be cast between said vertical panel means and extending parallel to each other in horizontal direction parallel to said vertical panel means and upwardly spaced from the horizontal panel means of said adjacent casting forms a distance corresponding to the thickness of a ceiling to be cast on said horizontal panel means.

6. An arrangement as defined in claim 5, wherein said parallel sidewalls of said intermediate body are respectively provided in an upper portion thereof with openings aligned with each other for the reception of bolts for connecting said rails to said sidewalls of said intermediate body.

7. An arrangement as defined in claim 6, wherein said rails are in the form of structural channels each having a pair of flanges, one of which abuts against the corresponding sidewall of the intermediate body, and including at least one bracket fixed to the upper end of said intermediate body and extending in a direction transverse to said sidewalls thereof, said bracket being provided at its outer ends with means for suspending the other flange of the respective structural channel thereon.

8. An arrangement as defined in claim 7, wherein two such brackets are connected to the projecting portions of said transverse walls, and including a pair of flaps respectively extending fixed to outer ends of said pair of brackets into the space between the flanges of the structural channels, and including fastening elements connecting the respective flaps with the respective flanges.

9. An arrangement as defined in claim 8, wherein said fastening elements are connected to said parallel sidewalls of said intermediate body.

10. An arrangement as defined in claim 8, wherein at least the flanges of said channels abutting against the sidewalls of said intermediate body are provided with openings alignable with and of the same diameter as said openings in said sidewalls, and including a tie rod having a diameter corresponding to that of said openings in said sidewalls and said flanges and extending through said openings for connecting the flanges of said two channels in spaced relationship to each other after removal of said intermediate body.

11. An arrangement as defined in claim 10, wherein each flap is provided with an opening aligned with those in said sidewalls, and wherein each flange of each channel is provided with an opening aligned with the opening in the other flange, all of said openings having the same diameter.

12. An arrangement as defined in claim 8, wherein said inclined transverse walls have in the region above the upper edges of said flanges of said structural channels parallel vertically extending portions to which said brackets are connected by welding.

13. An arrangement as defined in claim 5, wherein said inclined transverse walls are integrally formed from sheet metal and welded to said sidewalls.

* * * * *